US010047544B2

(12) United States Patent
Yen et al.

(10) Patent No.: US 10,047,544 B2
(45) Date of Patent: Aug. 14, 2018

(54) TRANSMISSION DEVICE OF ELECTRONIC LOCK

(71) Applicant: TLHM CO., LTD., Chiayi (TW)

(72) Inventors: Tony Yen, Chia-Yi (TW); Po-Yang Chen, Chia-yi (TW); Wei-Liang Chiang, Chia-Yi (TW); Song-Gen Shyu, Chia-Yi (TW); Rong-Faa Wu, Chia-Yi (TW); Kun-Chen Lee, Chia-Yi (TW)

(73) Assignee: TLHM CO., LTD., Chiayi (TW)

( * ) Notice: Subject to any disclaimer, the term of this patent is extended or adjusted under 35 U.S.C. 154(b) by 700 days.

(21) Appl. No.: 14/687,703

(22) Filed: Apr. 15, 2015

(65) Prior Publication Data

US 2015/0300048 A1 Oct. 22, 2015

(30) Foreign Application Priority Data

Apr. 17, 2014 (TW) ..... 103206689 U
Jul. 31, 2014 (TW) ..... 103213558 U

(51) Int. Cl.
*E05B 47/00* (2006.01)
*E05C 1/16* (2006.01)
*E05B 47/06* (2006.01)

(52) U.S. Cl.
CPC ..... *E05B 47/0012* (2013.01); *E05B 47/068* (2013.01); *E05C 1/163* (2013.01)

(58) Field of Classification Search
CPC ..... E05B 47/0673; E05B 2047/0026; E05B 65/1053; E05B 55/005; E05B 63/16; E05B 81/10; E05B 47/0012; E05B 47/068; Y10T 70/5416; Y10T 70/7062; Y10T 70/7107; Y10T 70/05; Y10T 292/1021; Y10T 292/57; E05C 1/163
USPC ... 70/221–224, 275, 277, 279.1, 283, 283.1; 292/336.3
See application file for complete search history.

(56) References Cited

U.S. PATENT DOCUMENTS 5,628,216 A * 5/1997 Qureshi ..... E05B 47/0012 292/201
5,694,798 A * 12/1997 Nunez ..... E05B 47/0661 70/224
7,918,114 B2 * 4/2011 Walsh, III ..... E05B 47/0661 70/223
8,302,438 B2 * 11/2012 Lui ..... E05B 47/0012 70/277
8,356,499 B2 * 1/2013 Peng ..... E05B 47/068 70/224
9,181,730 B1 * 11/2015 Peng ..... E05B 47/0012
(Continued)

*Primary Examiner* — Suzanne L Barrett
(74) *Attorney, Agent, or Firm* — Chun-Ming Shih

(57) ABSTRACT

A transmission device of an electronic lock, disposed in a lock body, each of both sides of the lock body is provided with a rose assembly, connected respectively to a handle, to drive a driving seat to bring a latch bolt of a latch unit into action. The transmission device is controlled electronically, comprising: a positioning element, a motor, an elastic element, a rod, a clutch element, and a spring. The clutch element is slideable in the spindle, to move between a first position where the clutch element engages with the spindle and a second position where the clutch element disengages from the spindle, such that when the clutch element engages with the spindle, the spindle drives the driving seat, to retract the latch bolt of the latch unit.

17 Claims, 6 Drawing Sheets

(56) References Cited

U.S. PATENT DOCUMENTS

| | | | | |
|---|---|---|---|---|
| 9,303,433 | B2 * | 4/2016 | Chiou | E05B 49/00 |
| 9,316,022 | B2 * | 4/2016 | Tyner | E05B 17/00 |
| 9,316,025 | B2 * | 4/2016 | Lien | E05B 47/0012 |
| 9,340,998 | B2 * | 5/2016 | Mani | E05B 47/068 |
| 9,834,959 | B2 * | 12/2017 | Mani | E05B 47/0012 |
| 2009/0277232 | A1 * | 11/2009 | Walsh, III | E05B 47/0661 70/278.7 |
| 2013/0305792 | A1 * | 11/2013 | Lien | E05B 47/0012 70/278.7 |

* cited by examiner

TRANSMISSION DEVICE OF ELECTRONIC LOCK

BACKGROUND OF THE INVENTION

Field of the Invention

The present invention relates to a transmission device of an electronic lock, and in particular to a transmission device of an electronic lock, in which an electronically controlled transmission device is disposed in a lock body of the electronic lock, so that the electronic lock is capable of being controlled to lock and unlock electronically.

The Prior Arts

It is well known in the Prior Art that, a door lockset can be provided with an electric actuator, to actuate a clutch that is capable of coupling an outside spindle rotatably to an outside sleeve connected to an outside handle. It is also well known in the Prior Art that, a lockset can be provided with a non-electrically operated clutch mechanism, to couple an outside spindle rotatably to an outside tube surrounding the outside spindle, that is connected to an outside handle.

While various mechanically and electrically operated clutch mechanisms are provided in the Prior Art to control transmission of rotation from an outside handle to an outside spindle, improvements are still needed for the clutch mechanism, to simplify construction and reduce manufacturing costs.

SUMMARY OF THE INVENTION

A major objective of the present invention is to provide a transmission device of an electronic lock, to overcome the shortcomings of the Prior Art. In this electronic lock, an electrically controlled transmission device is disposed in a lock body, so that that lock body can be controlled to lock and unlock electronically.

A transmission device of an electronic lock, with the transmission device adapted to be disposed in a lock body of the electronic lock, with the transmission device comprising:

a positioning element including a positioning hole;

a motor disposed in the positioning hole and including a shaft;

a rod including a first portion and a second portion, with the first portion including a fastening portion and a through hole, with the first portion of the rod mounted around the shaft, and with the second portion of the rod connected to a pin;

a clutch element disposed partially in a spindle, with the spindle disposed in a driving tube; and a spring disposed in the clutch element, with the clutch element restricting rotation of the spring, with the rod extending through the clutch element and the spring, with the pin of the rod driving the spring to move in an axial direction and to bring the clutch element to displace together in the axial direction, wherein the clutch element is slideable in the spindle between a first position where the clutch element engages with the spindle and a second position where the clutch element disengages from the spindle.

According to an aspect of the present invention, the present invention further includes an elastic element provided with at least a stop portion, the elastic element is disposed on the positioning element, such that at least a stop portion of the elastic element is abutted against the fastening portion of the first portion of the rod.

Moreover, the present invention provides a transmission device of an electronic lock, with the transmission device adapted to be disposed in a lock body of the electronic lock, with the transmission device comprising:

a positioning element including a positioning hole;

a motor disposed in the positioning hole of the positioning element and including a shaft;

an elastic element including at least one stop portion, with the elastic element disposed on the positioning element;

a rod including a first portion and a second portion, with the first portion of the rod connected to the shaft and including a fastening portion, with the second portion of the rod including a pin, with the at least one stop portion of the elastic element abutting against the fastening portion of the rod to prevent the rod from moving in an axial direction relative to the motor;

a driving tube including an indent slot;

a spindle received in the driving tube and including a first indent slot;

a clutch element including a protrusion block and disposed partially in the spindle; and a spring disposed in the clutch element, with the clutch element restricting rotation of the spring, with the rod extending through the clutch element and the spring, with the pin of the rod driving the spring to move in the axial direction and bring the clutch element to displace together in the axial direction, wherein the protrusion block of the clutch element is in the indent slot of the driving tube and is movable between a first position where the protrusion block engages with the indent slot of the spindle and a second position where the protrusion block disengages from the first indent slot of the spindle.

Further, the present invention provides a transmission device of an electronic lock, with the transmission device adapted to be disposed in a lock body of the electronic lock, with the transmission device comprising:

a positioning element including a positioning hole, an outer ring slot, and two fastening portions;

a motor disposed in the positioning hole of the positioning element and including a shaft;

an elastic element including a first element and two second elements, with each of the two second elements including a stop portion and a fastening portion, with the elastic element installed on the positioning element, with the first element of the elastic element received in an outer ring slot of the positioning element, with the fastening portions of the two second elements extending through the outer ring slot to fasten to the two fastening portions of the positioning element;

a rod including a first portion and a second portion, with the first portion including an end having a cylindrical portion, with the cylindrical portion including a through hole extending in the axial direction and having a non-circular cross section, with the shaft of the motor inserted into the through hole of the rod, with the first portion further including another end having a fastening portion opposite to the cylindrical portion, with the two stop portions of the elastic element abutting against the fastening portion of the rod, with the second portion of the rod connected to a pin located between and spaced from a first fastening ring and a second fastening ring;

a driving tube including an indent slot;

a spindle received in the driving tube and including a first indent slot;

a clutch element including a protrusion block and disposed partially in the spindle, with the clutch element including a first element and a second element, with the clutch element movable between the first fastening ring and the second fastening ring; and a spring disposed in the first element and the second element of the clutch element, with the clutch element restricting rotation of the spring, with the rod extending through the second element of the clutch element, the spring, and the first element of the clutch element, with the pin of the rod driving the spring to move in an axial direction and to bring the clutch element to displace together in the axial direction, wherein the protrusion block of the clutch element is slideable in the indent slot of the driving tube between a first position where the protrusion block engages with the first indent slot and a second position where the protrusion block disengages from the first indent slot.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

Figure 1:
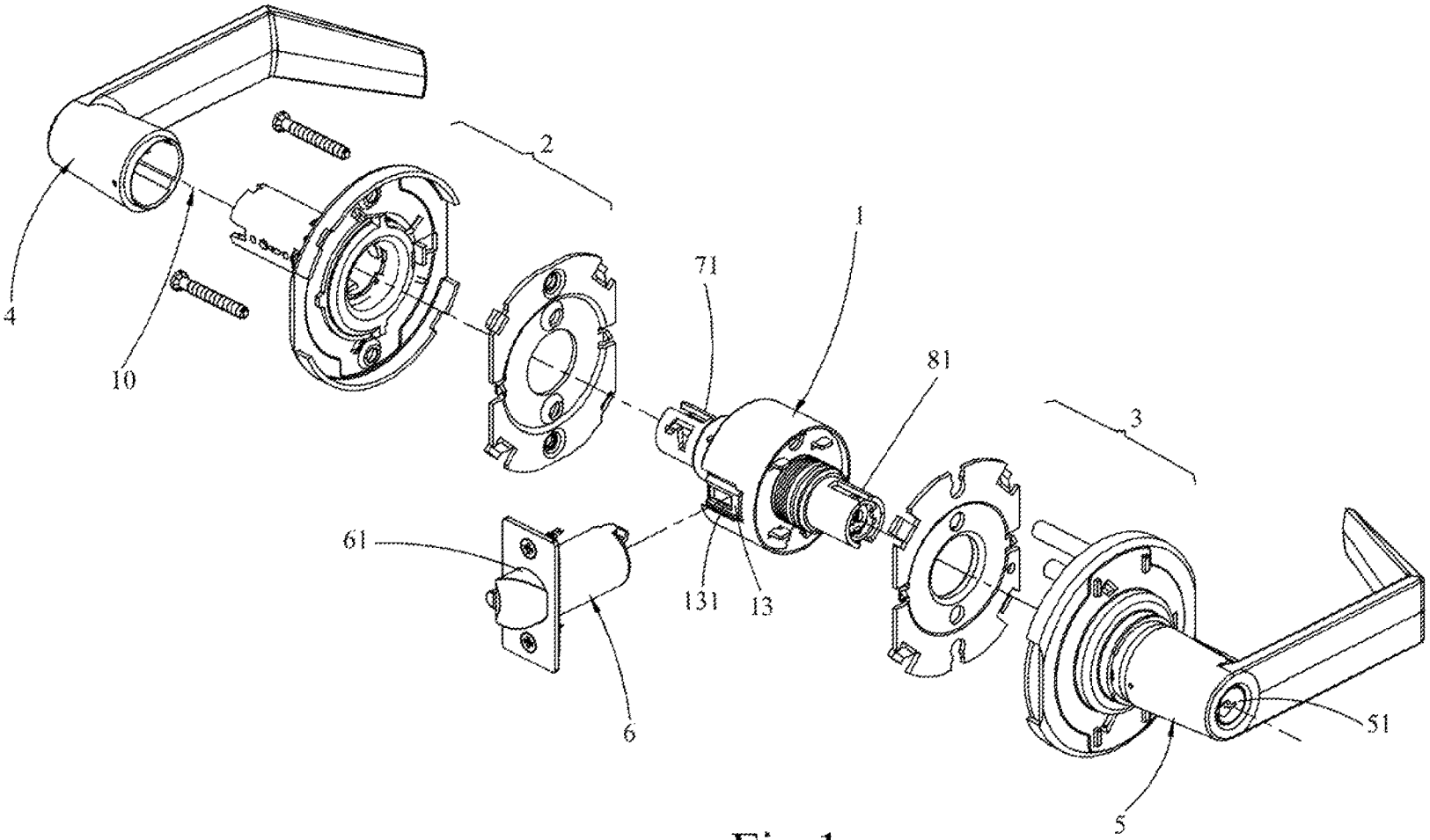
FIG. 1 is an exploded view of a lock body according to an embodiment of the present invention.
Figure 2:
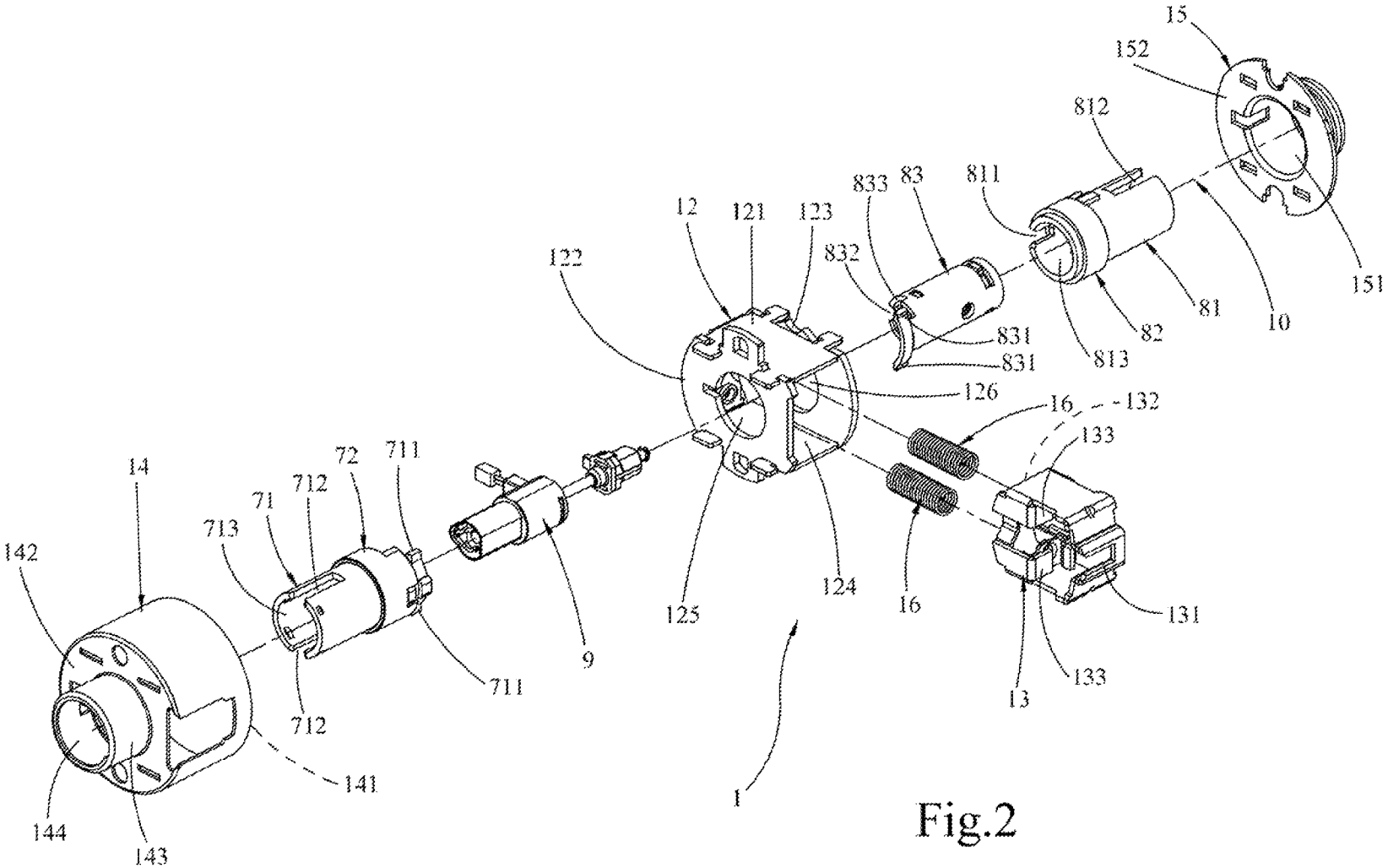
FIG. 2 is an exploded view of a driving device according to an embodiment of the present invention.

Refer to FIGS. 1 and 2 respectively for an exploded view of a lock body according to an embodiment of the present invention; and an exploded view of a driving device according to an embodiment of the present invention. As shown in FIGS. 1 and 2, the transmission device of an electronic lock is disposed in a driving device 1 of a lock body. Both sides of the lock body is provided respectively with an inside rose assembly 2 and an outside rose assembly 3, connected respectively to an inside handle 4 and an outside handle 5 or similar object, to drive a latch bolt 61 of a latch unit 6. Wherein, refer to FIG. 2, the driving device 1 includes: a shell 12, a sleeve 15, an outer shell 14, a driving seat 13, two elastic elements 16, an inner driving tube 71, an outer driving tube 81, a spindle 83, and an electronically controlled transmission device 9.

As shown in FIG. 2, the shell 12 is formed by a seat 121, an inside cover plate 122, an outside cover plate 123, so that the shell 12 is formed into a receiving room 124, and the inside cover plate 122 and the outside cover plate 123 are provided with a through hole 125 and a through hole 126 respectively.

Further, as shown in FIGS. 1 and 2, the front end of the driving seat 13 is provided with a connection portion 131, to engage with a driving element (not shown) inside the latch unit 6, to pull the latch bolt 61 of the latch unit 6. The rear end of the driving seat 13 is provided with a receiving portion 132, while two support portions 133 spaced apart are disposed between the connection portion 131 and the receiving portion 132. Two elastic elements 16 can be disposed respectively in the receiving room 124 of the shell 12 and the receiving portion 132 of the driving seat 13, and are located between the shell 12 and the driving seat 13, to serve as elastic support of the driving seat 13.

Moreover, as shown in FIGS. 1 and 2, the center of the outer driving tube 81 is provided with a center hole 813. One end of the outer driving tube 81 is provided with an indent slot 811, while its other end is provided with a long slot 812. The outer driving tube 81 is able to extend through the outside rose assembly 3, to connect directly or indirectly the outside handle 5, to operate the driving seat 13. A ring 82 can be sleeved directly onto the outer driving tube 81.

In addition, as shown in FIG. 2, the spindle 83 can be disposed in the center hole 813 of the outer driving tube 81, to rotate relative to the outer driving tube 81. One end of the spindle 83 is provided with two transmission portions 831 spaced apart, to abut respectively against the two support portions 133 of the driving seat 13; while its other end is provided with a driving portion (not shown), to be driven by the lock set 51 of the outside handle 5 (as shown in FIG. 1), and the position corresponding to the two transmission portions 831 is provided with a second indent slot 833. From the bottom portion of the second indent slot 833 is extended a first indent slot 832, such that width of the second indent slot 833 is greater than that of the first indent slot 832.

As shown in FIGS. 1 and 2, one end of the inner driving tube 71 is provided with two transmission portions 711 spaced apart, and abut against respectively on the two support portions 133 of the driving seat 13; while the other end of the inner driving tube 71 is provided with a long slot 712. The inner driving tube 71 is able to extend through the inside rose assembly 2, to connect directly or indirectly to the inside handle 4. The ring 72 can be sleeved directly around the inner driving tube 71.

Figure 3:
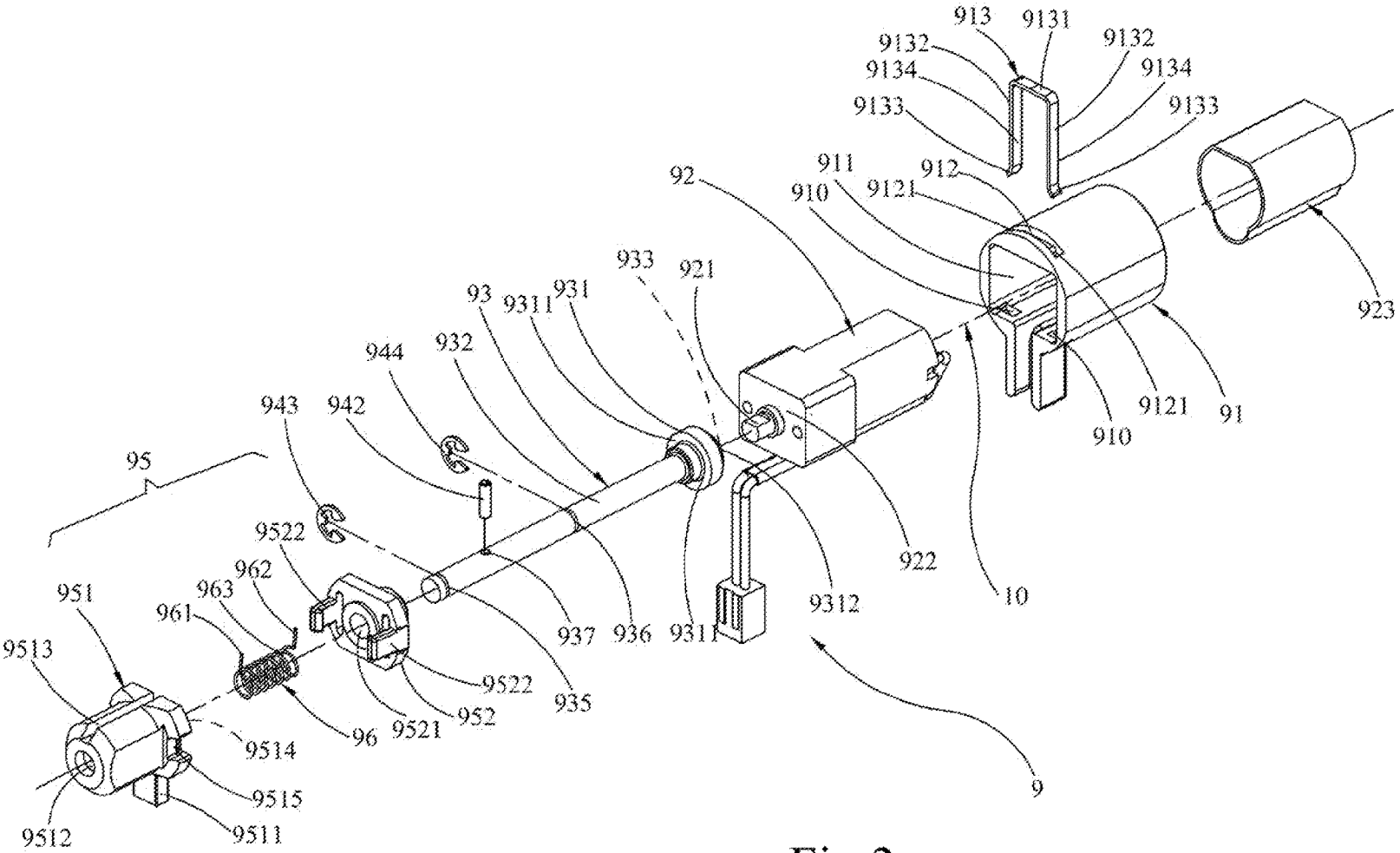
FIG. 3 is an exploded view of an electronically controlled transmission device according to an embodiment of the present invention.
Figure 5:
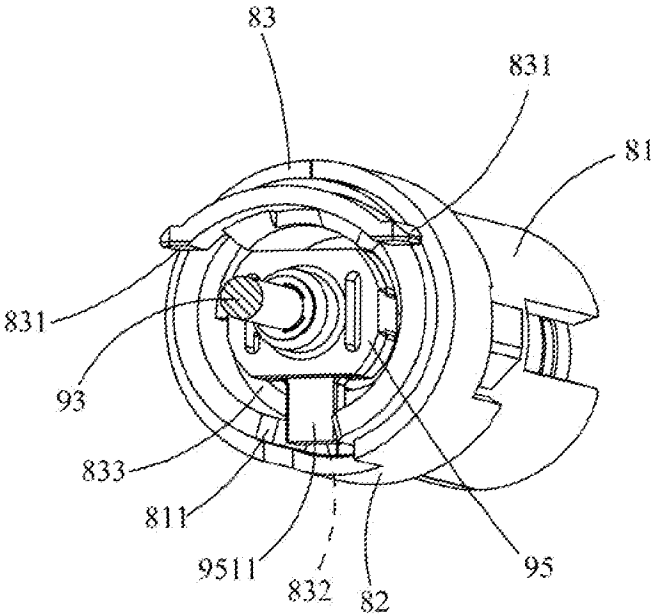
FIG. 5 is a perspective view of the assembled outer driving tube, ring, and spindle, wherein the protrusion block of the electronically controlled transmission device is kept in an indent slot of the outer driving tube while disengaging from the first indent slot of the spindle.
Figure 4:
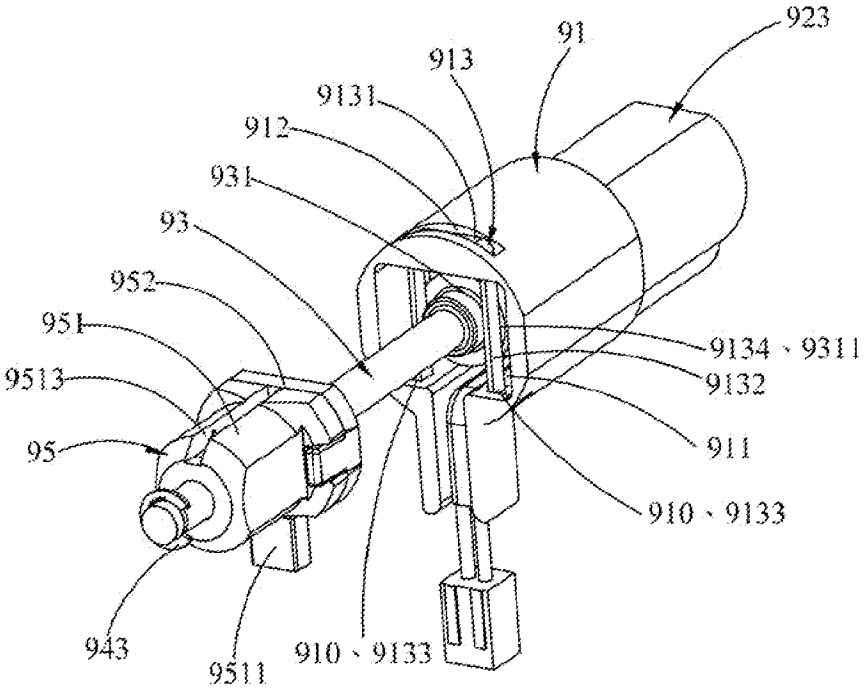
FIG. 4 is a perspective view of an assembled electronically controlled transmission device according to an embodiment of the present invention.

As shown in FIGS. 2, 3, and 4, the electronically controlled transmission device 9 can be disposed partially in the a center hole 713 of the inner driving tube 71. The electronically controlled transmission device 9 includes: a positioning element 91, a motor 92, a rod 93, a clutch element 95, and a spring 96. Wherein, the positioning element 91 is disposed in the center hole 713 of the inner driving tube 71. The positioning element 91 is provided with a positioning hole 911 and an outer ring slot 912. At the both ends of the bottom portion of the outer ring slot 912 are each formed a hole 9121, in communication with the positioning hole 911. The inner perimeter of the positioning hole 911 is provided with two fastening portions 910 spaced apart. The motor 92 is disposed in the positioning hole 911 of the positioning element 91. The motor 92 is provided with a shaft 921 and an end face 922. The shaft 921 defines an axial line 10, such that the partial cross section of the shaft 921 is formed into a non-circular shape. A heat contraction sleeve 923 is sleeved around one end of the motor 92, to fix the electrical wire of the motor.

As shown in FIGS. 2, 3, and 4, an elastic element 913 is provided with a first element 9131 and two second elements 9132. Two ends of the first element 9131 are connected to the two second elements 9132 respectively, while the elastic element 913 is of an inverted U-shape. The two second elements 9132 are each provided with a fastening portion 9133 and a stop portion 9134. Each of the fastening portions 9133 of the two second elements 9132 is able to extend through each of the two holes 9121 of the outer ring slots 912, to fasten to each of the two fastening portions 910 of the positioning element 91, so that the stop portions 9134 of the two second elements 9132 are received in the positioning holes 911 of the positioning element 91. The first element 9131 of the elastic element 913 is received in the outer ring slot 912, while the elastic element 913 remains disposed on the positioning element 91.

As shown in FIGS. 2, 3, 4, and 5, the rod 93 is provided with a first portion 931 and a second portion 932. One end of the first portion 931 is provided with a cylindrical portion 9312. The cylindrical portion 9312 is provided with a through hole 933 in its axial direction. The partial cross section of the through hole 933 is of a non-circular shape, so that it can match the shape of the partial cross section of the shaft 921. The first portion 931 is provided with a fastening portion 9311 on a side opposite to the cylindrical portion 9312.

In the present embodiment, the fastening portion 9311 is of a ring shape, so that one end of the second portion 932 of the rod 93 is connected to the first portion 931, while the other end is provided with a hole 937, for insertion of a pin 942. In the second portion 932 is formed a first fastening ring slot 935 and a second fastening ring slot 936 spaced apart on either side of the hole 937.

When it is desired to connect the rod 93 to the motor 92, it only requires to align the through hole 933 of the first portion 931 of the rod 93 to the shaft 921 of the motor 92. Since the cylindrical portion 9312 of the first portion 931 of the rod 93 has a slant face, and the minimum diameter of the cylindrical portion 9312 is less than the distance between the two second elements 9132 of the elastic element 913 parallel to each other; therefore, the cylindrical portion 9312 will press open the two second elements 9132 of the elastic element 913, so that the first portion 931 of the rod 93 is able to extend through the elastic element 913, to make the through hole 933 of the first portion 931 of the rod 93 engage with the shaft 921 of the motor 92.

In addition, since the two second elements 9132 of the elastic element 913 are elastic, and thus they can restore to their original positions, to make the two stop portions 9134 of the elastic element 913, to abut against respectively the fastening portion 9311 of the first portion 931 of the rod 93. The first portion 931 is defined between the two stop portions 9134 of the elastic element 913 and the end surface 922 of the motor 92.

Since the distance between the two second elements 9132 of the elastic element 913 is less than the maximum diameter of the cross section of the first portion 931 of the rod 93, therefore, this can effectively keep the relative positions of the rod 93 and the motor 92 (as shown in FIG. 4). The two fastening portions 910 of the positioning element 91 provides space, for the two fastening portions 9133 of the elastic element 913 be pressed open, to facilitate detaching the rod 93 from the shaft 921 of the motor 92, when the electronically controlled transmission device 9 breaks down.

As shown in FIGS. 2, 3, and 4, the clutch element 95 is provided with a first element 951, and a second element 952. Wherein, in the center of the first element 951 is provided with a through hole 9512 axially, in communication with a receiving hole 9514. In the outer perimeter of the first element 951 is provided with a long slot 9513 in communication with the receiving hole 9514. The inner diameter of the receiving hole 9514 is greater than the inner diameter of the through hole 9512, while one end of the first element 951 is provided with two fastening portions 9515 spaced apart. The center of the second element 952 is provided with a through hole 9521 axially, while around its outer perimeter is provided with two fastening portions 9522 spaced apart.

The spring 96 is provided with a spiral slot 963, with its two ends provided with a first bent portion 961 and a second bent portion 962 respectively. The spring 96 can be received in the receiving hole 9514 of the first element 951, while its first bent portion 961 and second bent portion 962 are received in the long slot 9513 of the first element 951. The two ends of the spring 96 abut against the position near the through hole 9512 of the first element 951 and the position near the through hole 9521 of the second element 952.

The rod 93 is able to extend through the hole 9521 of the second element 952, the spring 96, and the through hole 9512 of the first element 951, so that both ends of the pin 942 are located in spiral slot 963 of the spring 96, to fasten the two fastening portions 9522 of the second element 952 into the two fastening portions 9515 of the first element 951 respectively, to join them together. As such, a first fastening ring 943 and a second fastening ring 944 are fastened into the first fastening ring slot 935 and the second fastening ring slot 936 of the rod 93 respectively, to form the electronically controlled transmission device 9.

As shown in FIG. 2, the sleeve 15 is of a hollow barrel shape, its center is provided with a center hole 151, for the outer driving tube 81 to extend through. One end of the sleeve 15 is provided with a flange 152, to connect and fix onto one side of the shell 12. The outer shell 14 is of a barrel shape, with its one end provided with an opening 141, while the other end is provided with a shoulder 142. The shoulder 142 is extended into a tube 143, that is provided with a center hole 144 for the inner driving tube 71 to extend through, and to fix the outer shell 14 onto one side of the shell 12. The shell 12, the sleeve 15, and the outer shell 14 formed together into a whole body, to receive the driving seat 13 and the electronically controlled transmission device 9, in realizing the main body of the electronic lock.

Figure 6:
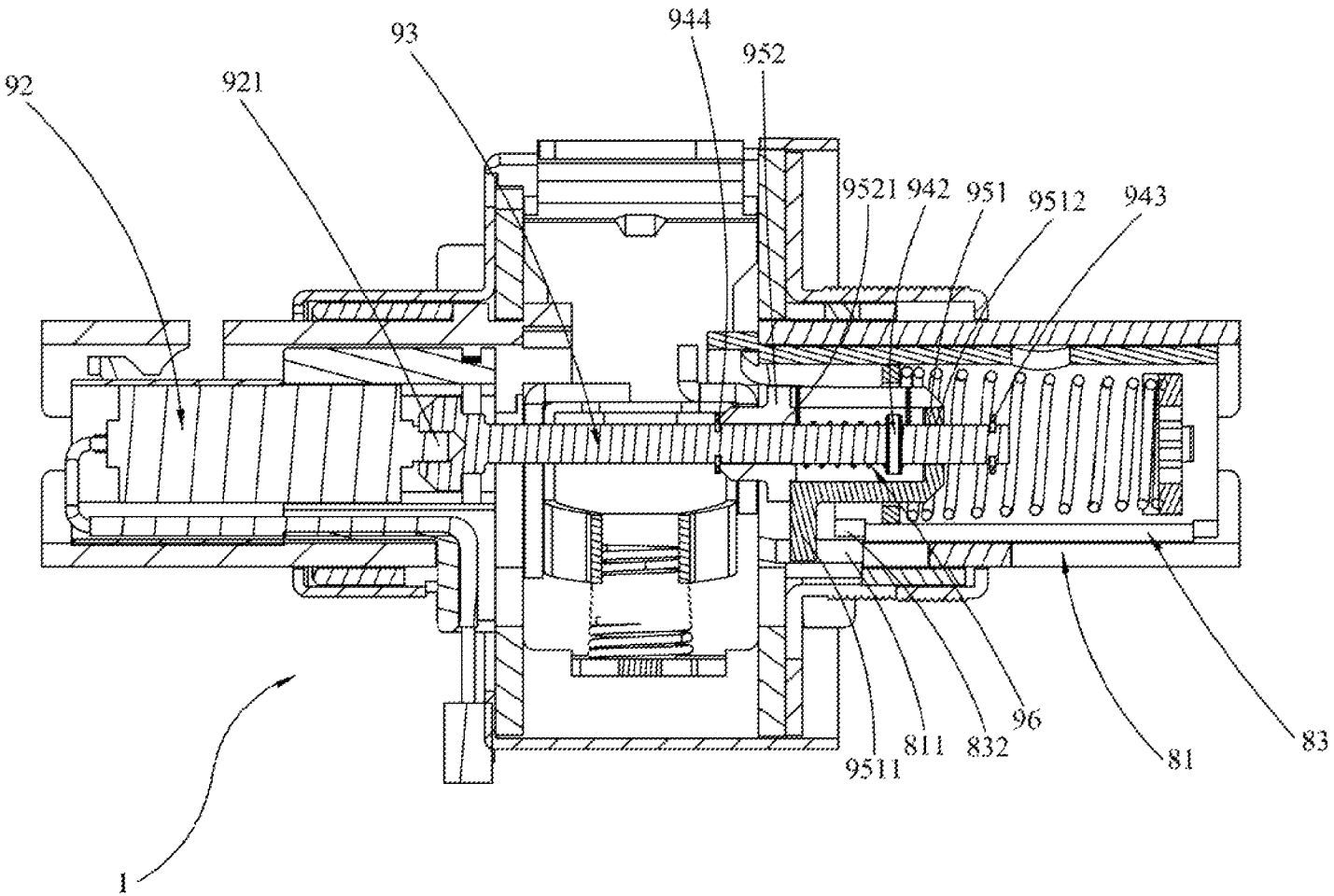
FIG. 6 is a cross section view of the assembled driving device, wherein the protrusion block of the electronically controlled transmission device is kept in an indent slot of the outer driving tube while disengaging from the first indent slot of the spindle.
Figure 7:
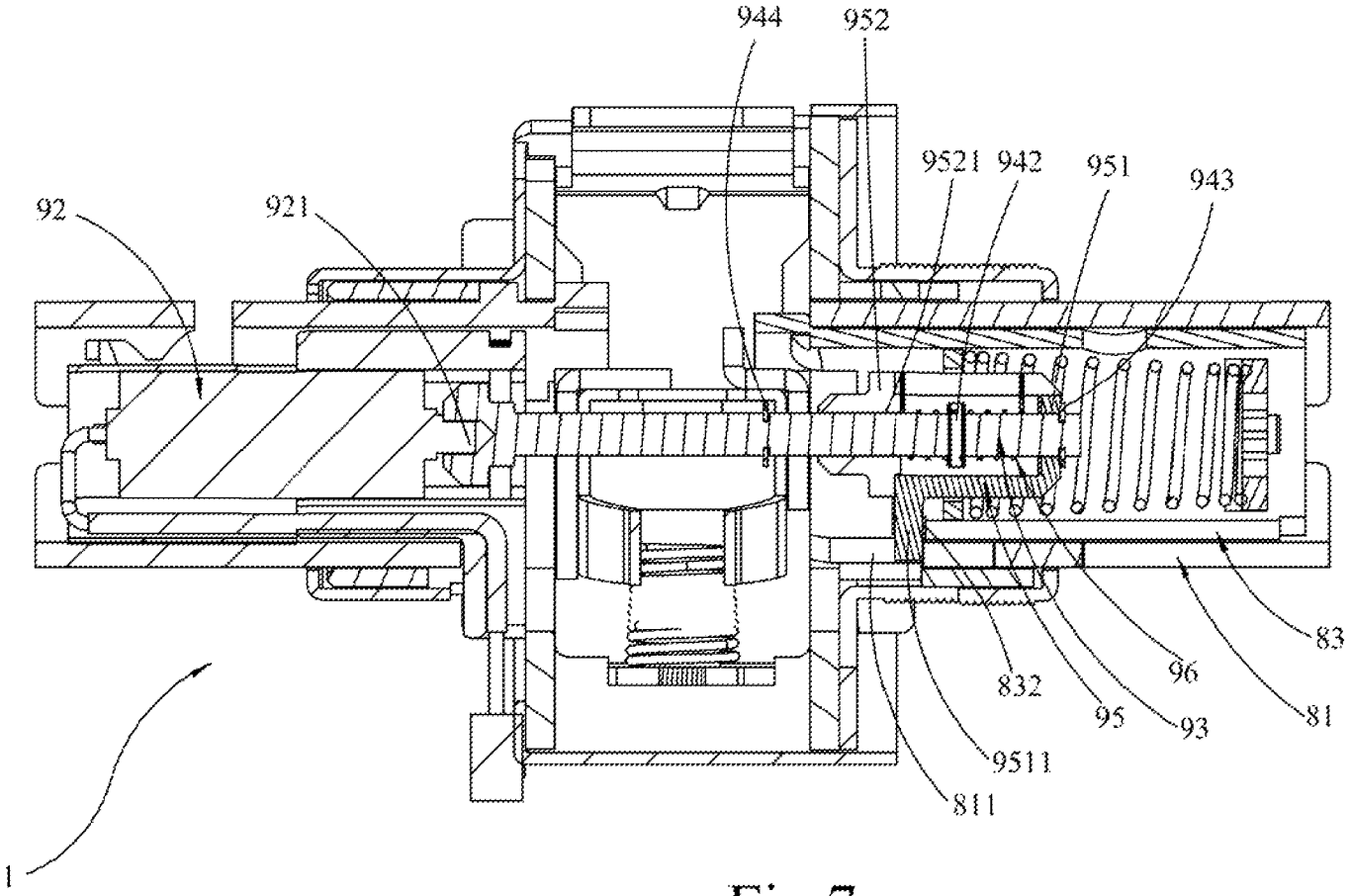
FIG. 7 is a cross section view of the assembled driving device, wherein the protrusion block of the electronically controlled transmission device is kept in an indent slot of the outer driving tube while engaging with the first indent slot of the spindle.

Refer to FIGS. 1 to 4, 6, and 7 to describe the operation of the transmission device of the electronic lock. Wherein, the input device (not shown) can be of a push button type, remote control type, touch control type, or an induction type. The input device is connected electrically to a control unit (not shown), that is powered by a power supply device (not shown), to receive and process the signals transmitted through the input device. The control unit is capable of determining the correctness of the signals received, and it outputs signals to control the shaft 921 of the motor 92 to make forward or reverse rotations, to bring the rod 93 into rotation. As such, through the rotation of the two ends of the pin 942 in the spiral slot 963 of the spring 96, and since the two ends of the spring 96 are supported respectively by the first element 951 and the second element 952, such that the first bent portion 961 and the second bent portion 962 of the spring 96 are restricted to move in the long slot 9513 of the first element 951. Therefore, the protrusion block 9511 of the clutch element 95 can be kept in the indent slot 811 of the outer driving tube 81, to slide in a direction parallel to the axial line 10. In this way, the protrusion block 9511 is made to move between a first position where the protrusion block 9511 engages with the first indent slot 832 of the spindle 83 (as shown in FIG. 7), and a second position where the protrusion block 9511 disengages from the first indent slot 832 of the spindle 83 (as shown in FIG. 6).

As shown in FIGS. 1, 3, 6, and 7, when the lock body is in an unlocked state, the pin 942 of the rod 93 is located close to the through hole 9521 of the second element 952. When an electronic signal is issued to lock the lock body, the lock signal is sent to the electronically controlled transmission device 9, to drive the shaft 921 of the motor 92 to rotate counter clockwise (as shown in FIG. 3), so that the pin 942 is slideable from the second bent portion 962 of the spring 96 into the spiral slot 963 of the spring 96. Since the rotation of the spring 96 is restricted, the clutch element 95 will move from the position near the first fastening ring 943 toward the position near the second fastening ring 944, so that the protrusion block 9511 will slide in the indent slot 811 of the outer driving tube 81, to move to the position where the protrusion block 9511 disengages from the first indent slot 832 of the spindle 83, and close to the bottom of the second indent slot 833. Wherein, when the pin 942 is rotated in the spiral slot 963, to rotate from the position near the through hole 9521 of the second element 952 to the position near the through hole 9512 of the first element 951. In case the rod 93 continues rotating, the pin 942 will slide out from the first bent portion 961 of the spring 96, so that the pin 942 of the rod 93 will rotate freely, and the clutch element 95 will not move. At this time, the outside handle 5 is rotated, to drive the outer driving tube 81, so that the outer driving tube 81 will bring the protrusion block 9511 to slide on the bottom of the second indent slot 833 of the spindle 83. As such, it can not drive the transmission portion 831 of the spindle 83 to drive the driving seat 13 to pull inner driving element (not shown) of the latch unit 6 to act on the latch bolt 61. In this way, the outside handle 5 will rotate freely for a certain degree, so that the lock body is in a locked state.

As shown in FIGS. 1, 3, 6, and 7, when the lock body is in an locked state, the pin 942 of the rod 93 is located close to the through hole 9512 of the first element 951. When an electronic signal is issued to unlock the lock body, the unlocking signal is sent to the electronically controlled transmission device 9, to drive the shaft 921 of the motor 92 to rotate clockwise (as shown in FIG. 3), so that the pin 942 slides from the first bent portion 961 of the spring 96 into the spiral slot 963 of the spring 96. Since the rotation of the spring 96 is restricted, the clutch element 95 will move from the position near the second fastening ring 944 toward the position near the first fastening ring 943, so that the protrusion block 9511 will slide in the indent slot 811 of the outer driving tube 81, to move to the position where the protrusion block 9511 engages with the first indent slot 832 of the spindle 83. Wherein, when the pin 942 is rotated in the spiral slot 963, to rotate from near the through hole 9512 of the first element 951 to near the through hole 9521 of the second element 952; in case the rod 93 continues rotating, the pin 942 will slide out from the second bent portion 962 of the spring 96, so that the pin 942 of the rod 93 will rotate freely, and the clutch element 95 will not move. At this time, the outside handle 5 is rotated, to drive the outer driving tube 81, such that the outer driving tube 81 will bring the protrusion block 9511 and the spindle 83 to rotate, to drive the transmission portion 831 of the spindle 83 to drive the driving seat 13, to pull the inner driving element (not shown) of the latch unit 6 to act on the latch bolt 61, so as to make the lock body in an unlock state. When the outside handle 5 is released, the driving seat 13 will return to its original position due to the restoring force of the two elastic elements 16. At this time, the inner driving element (not shown) of the latch unit 6 will also return to its original position due to the restoring force of the inner elastic element, to make the latch bolt 61 in a protruded position.

Further, as shown in FIG. 1, when it is desired to unlock the lock from inside the door, it only requires to rotate the inside handle 4, to bring the two transmission portions 711 of the inner driving tube 71 to drive the driving seat 13, to pull the inner driving element (not shown) of the latch unit 6 to act on the latch bolt 61, so that the latch bolt 61 is in a retracted position. When the inside handle 4 is released, the driving seat 13 will return to its original position due to the restoring force of the two elastic elements 16. At this time, the inner driving element (not shown) of the latch unit 6 will also return to its original position due to the restoring force of the inner elastic element, to make the latch bolt 61 in a protruded position.

Finally, as shown in FIG. 1, in the present invention, the lock body is provided with a lock set 51. For the lock set 51, a key (not shown) can be used to insert into, to drive the spindle 83 directly, to drive the transmission portion 831 of the spindle 83 in turn to drive the driving seat 13, to pull the inner driving element (not shown) of the latch unit 6 to act on the latch bolt 61, so as to make the latch bolt 61 into a retracted position. In order for the lock body being able to be used in various occasions, the transmission device of the electronic lock can be designed to utilize in a lock body not provided with a lock set 51, yet this belongs to the lock of the prior art, thus it will not be repeated here for brevity.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A transmission device of an electronic lock, with the transmission device adapted to be disposed in a lock body of the electronic lock, with the transmission device comprising:

a positioning element including a positioning hole;

a motor disposed in the positioning hole and including a shaft;

a rod including a first portion and a second portion, with the first portion including a fastening portion and a through hole, with the first portion of the rod mounted around the shaft, and with the second portion of the rod connected to a pin;

a clutch element disposed partially in a spindle, with the spindle disposed in a driving tube; and a spring disposed in the clutch element, with the clutch element restricting rotation of the spring, with the rod extending through the clutch element and the spring, with the pin of the rod driving the spring to move in an axial direction and to bring the clutch element to displace together in the axial direction, wherein the clutch element slides in the spindle between a first position where the clutch element engages with the spindle and a second position where the clutch element disengages from the spindle.

2. The transmission device of an electronic lock as claimed in claim 1, further comprising: an elastic element, provided with at least a stop portion, the elastic element is disposed on the positioning element, such that the at least a stop portion of the elastic element is abutted against the fastening portion of the first portion of the rod.

3. The transmission device of an electronic lock as claimed in claim 1, wherein the driving tube is provided with an indent slot, the spindle is provided with a first indent slot and a second indent slot, width of the second indent slot is greater than width of the first indent slot; the clutch element is provided with a first element and a second element, the first element is provided with a protrusion block and a receiving hole, the protrusion block slides in an indent slot of the driving tube, and is made to move between a first position where the protrusion block engages with the first indent slot of the spindle, and a second position where the protrusion block disengages from the first indent slot of the spindle, the receiving hole is connected to a long slot, while one end of the spring abuts against the first element, while the other end of the spring abuts against the second element, the spring is provided with a first bent portion and a second bent portion, the first bent portion and the second bent portion are received in the long slot of the clutch element.

4. The transmission device of an electronic lock as claimed in claim 3, wherein the first element of the clutch element is provided with at least a fastening portion, and the second element of the clutch element is provided with at least a fastening portion, such that the at least a fastening portion of the first element of the clutch element is fastened to the at least a fastening portion of the second element of the clutch element.

5. The transmission device of an electronic lock as claimed in claim 1, wherein the elastic element is provided with a first element and at least a second element, on the second element is formed a stop portion and a fastening portion, one end of the first portion of the rod opposite the fastening portion is provided with a cylindrical portion, the cylindrical portion is provided with the through hole in an axial direction thereof.

6. The transmission device of an electronic lock as claimed in claim 5, wherein the positioning element is provided with an outer ring slot and at least a fastening portion, a bottom portion of the outer ring slot is provided with at least a hole, such that the hole is in communication with the positioning hole, the first element of the elastic element is received in the outer ring slot, while the fastening portion of the second element of the elastic element extends through the hole of the outer ring slot, to fasten to the fastening portion of the positioning element, so that the stop portion is received in the positioning hole.

7. The transmission device of an electronic lock as claimed in claim 1, wherein the second portion of the rod is provided with a hole to receive the pin, both sides of the rod adjacent the pin are provided respectively with a first fastening ring and a second fastening ring, such that the clutch element is moved between the first fastening ring and the second fastening ring.

8. The transmission device of an electronic lock as claimed in claim 1, wherein the clutch element is provided with a protrusion block, the protrusion block slides in the indent slot of the driving tube, to move between a first position where the protrusion block engages with the spindle, and a second position where the protrusion block disengages from the spindle.

9. A transmission device of an electronic lock, with the transmission device adapted to be disposed in a lock body of the electronic lock, with the transmission device comprising:

a positioning element including a positioning hole;

a motor disposed in the positioning hole of the positioning element and including a shaft;

an elastic element including at least one stop portion, with the elastic element disposed on the positioning element;

a rod including a first portion and a second portion, with the first portion of the rod connected to the shaft and including a fastening portion, with the second portion of the rod including a pin, with the at least one stop portion of the elastic element abutting against the fastening portion of the rod to prevent the rod from moving in an axial direction relative to the motor;

a driving tube including an indent slot;

a spindle received in the driving tube and including a first indent slot;

a clutch element including a protrusion block and disposed partially in the spindle; and a spring disposed in the clutch element, with the clutch element restricting rotation of the spring, with the rod extending through the clutch element and the spring, with the pin of the rod driving the spring to move in the axial direction and bring the clutch element to displace together in the axial direction, wherein the protrusion block of the clutch element is in the indent slot of the driving tube and is moved between a first position where the protrusion block engages with the first indent slot of the spindle and a second position where the protrusion block disengages from the first indent slot of the spindle.

10. The transmission device of an electronic lock as claimed in claim 9, wherein the clutch element is provided with a first element and a second element, the first element of the clutch element is provided with a receiving hole, and is connected and in communication with a long slot, one end of the spring abuts against the first element, while the other end of the spring abuts against the second element, the spring is provided with a first bent portion and a second bent portion, the first bent portion and the second bent portion are received in the long slot of the first element of the clutch element.

11. The transmission device of an electronic lock as claimed in claim 10, wherein the first element of the clutch element is provided with at least a fastening portion, and the second element of the clutch element is provided with at least a fastening portion, such that the at least a fastening portion of the first element of the clutch element is fastened to the at least a fastening portion of the second element of the clutch element.

12. The transmission device of an electronic lock as claimed in claim 9, wherein one end of the first portion of the rod is provided with a cylindrical portion, the cylindrical portion is provided with a through hole in an axial direction thereof, the through hole is sleeved around the shaft, while other side of the first portion of the rod opposite the cylindrical portion is provided with the fastening portion, and the second portion is provided with a hole for receiving the pin.

13. The transmission device of an electronic lock as claimed in claim 12, wherein the elastic element is provided with a first element and at least a second element, on the second element is formed the stop portion and a fastening portion.

14. The transmission device of an electronic lock as claimed in claim 13, wherein the positioning element is provided with an outer ring slot and at least a fastening portion, a bottom portion of the outer ring slot is provided with at least a hole, such that the hole is in communication with the positioning hole, the first element of the elastic element is received in the outer ring slot, while the fastening portion of the second element of the elastic element extends through the hole of the outer ring slot, to fasten to the fastening portion of the positioning element, so that the stop portion is received in the positioning hole.

15. The transmission device of an electronic lock as claimed in claim 9, wherein two sides of the rod adjacent to the pin are provided respectively with a first fastening ring and a second fastening ring, such that the clutch element is made to move between the first fastening ring and the second fastening ring.

16. A transmission device of an electronic lock, with the transmission device adapted to be disposed in a lock body of the electronic lock, with the transmission device comprising:

a positioning element including a positioning hole, an outer ring slot, and two fastening portions;

a motor disposed in the positioning hole of the positioning element and including a shaft;

an elastic element including a first element and two second elements, with each of the two second elements including a stop portion and a fastening portion, with the elastic element installed on the positioning element, with the first element of the elastic element received in an outer ring slot of the positioning element, with the fastening portions of the two second elements extending through the outer ring slot to fasten to the two fastening portions of the positioning element;

a rod including a first portion and a second portion, with the first portion including an end having a cylindrical portion, with the cylindrical portion including a through hole extending in the axial direction and having a non-circular cross section, with the shaft of the motor inserted into the through hole of the rod, with the first portion further includes another end having a fastening portion opposite to the cylindrical portion, with the two stop portions of the elastic element abutting against the fastening portion of the rod, with the second portion of the rod connected to a pin located between and spaced from a first fastening ring and a second fastening ring;

a driving tube including an indent slot;

a spindle received in the driving tube and including a first indent slot;

a clutch element including a protrusion block and disposed partially in the spindle, with the clutch element including a first element and a second element, with the clutch element moving between the first fastening ring and the second fastening ring; and a spring disposed in the first element and the second element of the clutch element, with the clutch element restricting rotation of the spring, with the rod extending through the second element of the clutch element, the spring, and the first element of the clutch element, with the pin of the rod driving the spring to move in an axial direction and to bring the clutch element to displace together in the axial direction, wherein the protrusion block of the clutch element slides in the indent slot of the driving tube between a first position where the protrusion block engages with the first indent slot and a second position where the protrusion block disengages from the first indent slot.

17. The transmission device of an electronic lock as claimed in claim 16, wherein a minimum diameter of the cylindrical portion of the first portion of the rod is less than that of a distance between the two second elements of the elastic element disposed parallel to each other.

* * * * *